United States Patent [19]

Jaklic

[11] Patent Number: 4,491,703

[45] Date of Patent: Jan. 1, 1985

[54] DETENTING AND CONTACT REGISTRATION SYSTEM FOR A LINEAR DIP SWITCH

[75] Inventor: Fred Jaklic, Brookfield, Ill.

[73] Assignee: Grayhill, Inc., LaGrange, Ill.

[21] Appl. No.: 527,218

[22] Filed: Aug. 30, 1983

[51] Int. Cl.[3] ..... H01H 15/00; H01H 9/00

[52] U.S. Cl. ..... 200/16 D; 200/291

[58] Field of Search ..... 200/11 DA, 11 G, 11 TW, 200/16 R, 16 C, 16 D, 16 F, 291, 292

[56] References Cited

U.S. PATENT DOCUMENTS

| | | | |
|---|---|---|---|
| 3,293,399 | 12/1966 | Heinrich | 200/11 TW |
| 3,550,157 | 12/1970 | Pfleger | 200/11 TW X |
| 3,604,863 | 9/1971 | Schink | 200/16 C |
| 3,699,279 | 10/1972 | Lockard et al. | 200/11 DA X |
| 3,781,866 | 12/1973 | Kilby | 200/16 C X |
| 3,786,206 | 1/1974 | Kurimsky | 200/16 D |
| 4,012,608 | 3/1977 | Lockard | 200/16 D |
| 4,152,565 | 5/1979 | Rose | 200/16 A |
| 4,332,987 | 6/1982 | Hoffman | 200/16 D |
| 4,352,966 | 10/1982 | English et al. | 200/16 D |

*Primary Examiner*—J. R. Scott

*Attorney, Agent, or Firm*—Lee, Smith & Zickert

[57] ABSTRACT

A linear DIP switch for mounting directly on a printed circuit board including a base, a slide actuator, and a cover member, wherein the base, slide actuator and cover member include a detenting and contact registration system. The base includes a plurality of contacts molded into a body of plastic so that they are electrically insulated from each other and selectively exposed on the slide actuator side through openings in the plastic body which define detenting and contact positions to receive contact arms carried by the slide actuator. Further detenting means includes ball detents carried by the slide actuator and engageable with indent track means on the cover side walls.

10 Claims, 8 Drawing Figures

DETENTING AND CONTACT REGISTRATION SYSTEM FOR A LINEAR DIP SWITCH

BACKGROUND OF THE INVENTION

This invention relates in general to miniature switches, and more particularly to linear DIP switches adapted to be directly mounted on a printed circuit board, and still more particularly to a linear DIP switch having a unique detenting and registration system.

Heretofore, linear DIP switches have been well known, and it has also been well known to provide such switches with detenting and registration systems as disclosed in U.S. Pat. Nos. 4,012,608 and 4,332,987. However, the detenting and registration systems of these switches are not capable of being efficient for many cycles of operation as they depend solely upon leaf-spring arms with light forces to accomplish the detenting function for the various switch positions and have inadequate insulation between contact positions. Moreover, they do not give the precise positioning and switching function throughout their life which is important to the proper switch and circuit programming for a printed circuit board.

The present invention obviates the difficulties heretofore encountered in linear DIP switches in providing more positive detenting and registering action and increasing the life of the switch because of the capability of withstanding many more cycles of operation, thereby giving more accurate programming for a printed circuit board. The switch of the present invention includes a contact registration system defined by a base having a plurality of contacts molded therein and selectively exposed on their upper surfaces through openings formed in the molded material at each detented position, thereby defining electrical insulation between switch positions. Contacts are only exposed to contact arm engagement through openings in the molded base. Contact arms are carried by a slide actuator, and the ends of the arms are formed with arcuate portions which are sized to be received within the openings on the base and which coact with the openings to give a detenting action of the actuator as it is moved longitudinally of the base. Additional detenting action is provided by a pair of ball detents carried by the slide actuator and resiliently biased by a coil spring against indent tracks formed along the side walls of the cover. The forces generated by the coil spring detenting system are substantially greater than those generated by the contact arms.

It is therefore an object of the present invention to provide a new and improved linear DIP switch for printed circuit boards having a unique detenting and registration system for providing more positive detenting and registration action between switch positions and more positive electrical isolation of contacts between said positions.

Another object of the invention is in the provision of a linear DIP switch including a slide actuator having ball detents engageable with indent track means on the housing of the switch and contact arms engaging contacts having portions exposed at each switch position in accordance with the desired programming of the switch position.

A still further object of the present invention is in the provision of a linear DIP switch that is simply constructed of a relatively small number of parts and which can be quickly and easily assembled for providing a switch having a more positive and accurate detenting and registration system to provide more reliable switching operation.

BRIEF DESCRIPTION OF THE DRAWINGS

Other objects, features and advantages of the invention will be apparent from the following detailed disclosure, taken in conjunction with the accompanying sheets of drawings, wherein like reference numerals refer to like parts, in which.

BRIEF DESCRIPTION OF THE PREFERRED EMBODIMENT

Figure 1:
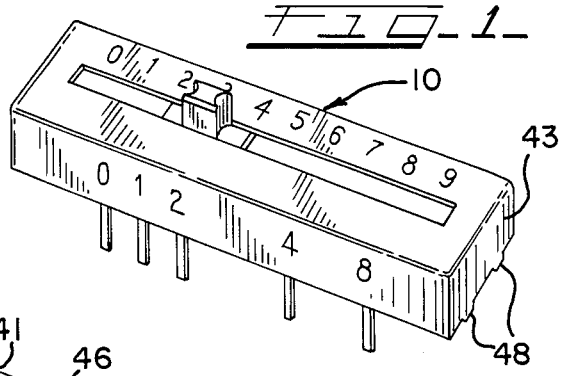
FIG. 1 is a perspective view of the switch of the present invention.
Figure 2:
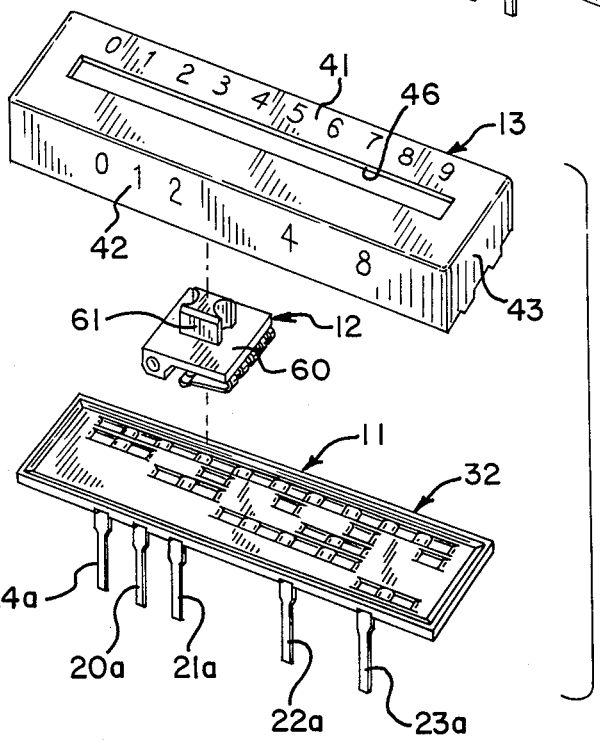
FIG. 2 is an exploded view of the switch shown in FIG. 1 showing in more detail the base and slide actuator.

Referring now to the drawings, and particularly to FIGS. 1 and 2, the linear DIP switch of the present invention is generally designated by the numeral 10 and includes generally a base 11, a slide actuator or slider 12, and a cover 13. The switch illustrated herein is one form of linear DIP switch contemplated by the invention in that it is formed to define a binary code switch having ten switch positions. It will be appreciated that it also may be formed to provide what is known in the industry as a tap switch or a circuit switch having any desired number of positions, contacts and terminals where a linear action DIP switch is desired.

The base 11, as seen particularly in FIGS. 3, 5 and 6 to 8, is formed from a terminal blank 18 which includes contact bars 19, 20, 21, 22, 23 and 24 of varying lengths having integrally formed therewith termainls 19*a*, 20*a*, 21*a*, 22*a*, 23*a* and 24*a*. The contact bar arrangement may differ from that illustrated depending on the switch function desired. The terminal blank is of a suitable metal such as brass or a copper alloy and stamped from a sheet in a well known fashion. As can be appreciated, the contact bar 19 runs the full length of the terminal blank and would constitute a common. It includes a plurality of terminals 19*a*, while each of the other contact bars only include a single terminal although each contact bar may be provided with plural terminals. Circuits are therefore established between the common contact bar and one or more of the other contact bars. In order to properly support the terminals and the contact bars during molding of the body onto the terminal blank, carrying strips 25 and 26 support the ends of the contact bars, while carrying strips 27 and 28 support the ends of the terminals.

Figure 7:
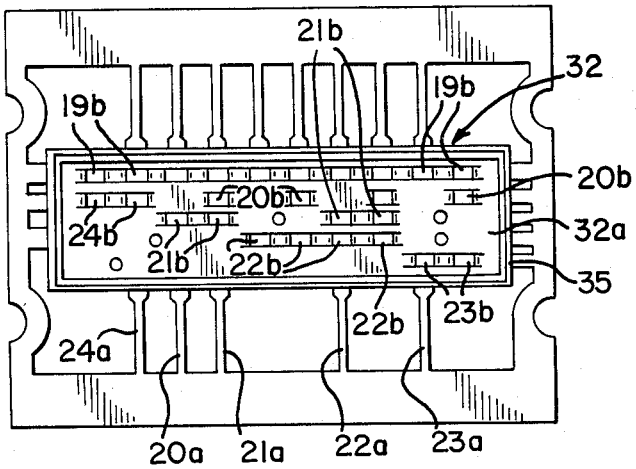
FIG. 7 is a top plan view similar to FIG. 6 but showing the plastic body molded onto the terminal and contact members.
Figure 8:
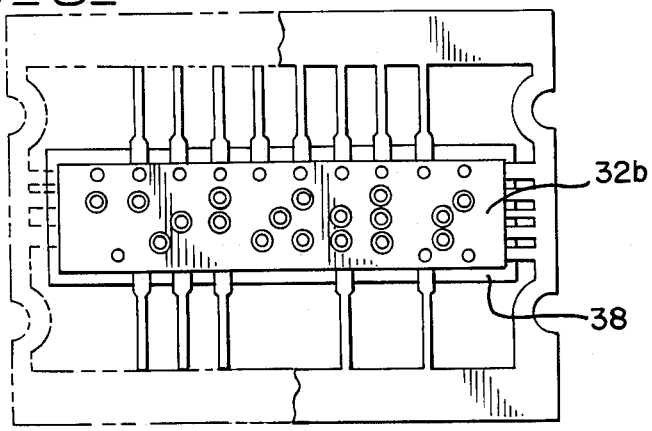
FIG. 8 is a bottom plan view of the assembly of FIG. 7 and showing in phantom how the carrying portions of the terminal blank are removed.

The base is further formed by molding a plastic body 32 onto the contact bars and terminals, as shown particularly in FIGS. 7 and 8, so that the contact bars are embedded in the plastic body. The upper surface 32*a* of the plastic body is formed with a plurality of contact bar openings 19*b*, 20*b*, 21*b*, 22*b*, 23*b* and 24*b* corresponding with the contact bars 19 to 24, defining a plurality of base contacts. It will be noted that along the common contact bar 19 a contact opening is provided at each position along the base, while a lesser number of contact openings are provided for other contact bars at preselected positions such that the desired circuits can be established at each of the ten positions along the switch. Following molding of the body 32 which then rigidly supports the contact bars and terminals and particularly electrically insulates the contact bars and terminals from each other, the carrier strips are suitably cut free in a manner as partially illustrated in FIG. 8, and the terminals can then be bent downwardly to the form illustrated in FIGS. 1, 2 and 5.

Figure 3:
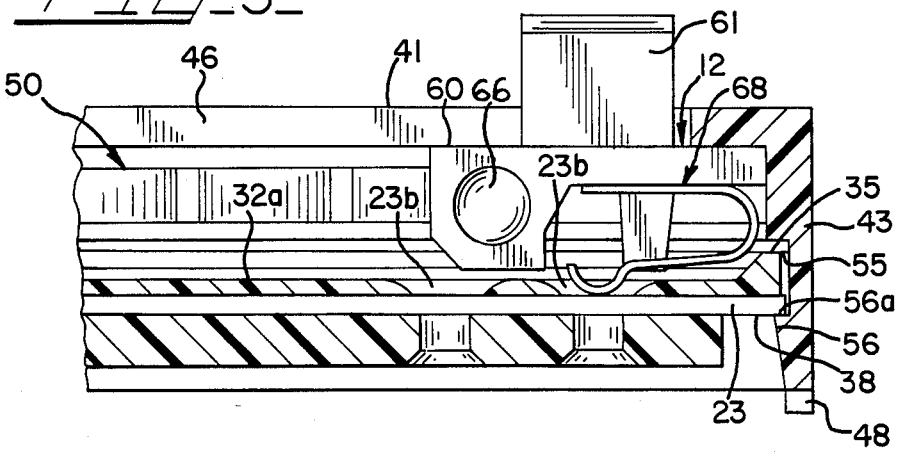
FIG. 3 is an enlarged vertical fragmentary sectional view taken through the switch of FIG. 1 and showing the slide actuator in side elevation.
Figure 5:
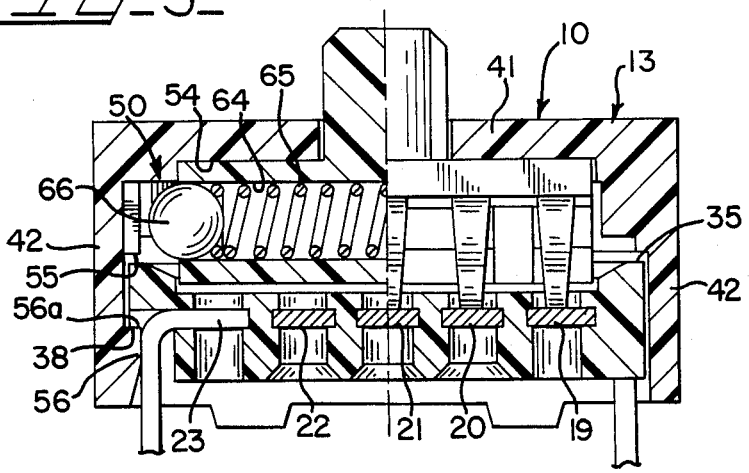
FIG. 5 is a transverse sectional view taken through the switch and generally along lines 5—5 of FIG. 4.
Figure 6:
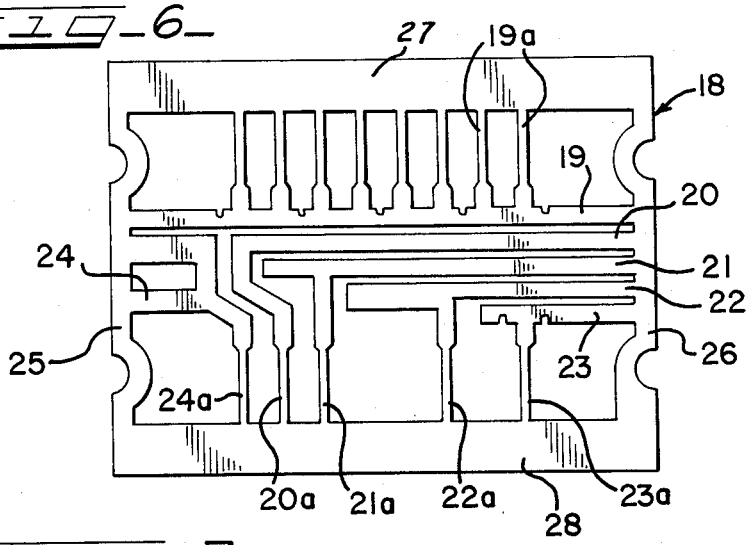
FIG. 6 is a top plan view of the terminal blank which includes contacts and terminals and which is employed for making the base of the switch of the invention.

The outer periphery of the plastic body 32 includes an upwardly projecting ridge 35 which, as seen particularly in FIGS. 3 and 5, terminates in spaced relation above the upper surface 32*a* of the plastic body. As also seen particularly in FIG. 3, the opposite edges of the openings in the plastic body, which edges extend across the switch body, are provided with arcuate or sloping surfaces to facilitate the movement of the contact arms of the slide actuator into and out of the openings. The lower surface 32*b* of the body 32 is planar and terminates short of the outer edges of the base, as seen particularly in FIGS. 3, 5 and 8, to thereby define a retaining shoulder 38 peripheral of the base for coacting with retention members on the cover, as will be more clearly explained hereafter.

The cover member 13 includes a top wall 41, opposed side walls 42, and opposed end walls 43. The top wall includes a longitudinal slot 46 centrally arranged and through which the button or handle of the slide actuator 12 extends, as will be explained below. Suitable indicia may be provided on the top wall as well as a side wall, as shown in FIGS. 1 and 2, to not only indicate the position of the slide actuator but also the circuits made at a particular position. At the lower edges of the end walls 43, standoffs 48 and provided to slightly space the switch from the top surface of the printed circuit board.

Figure 4:
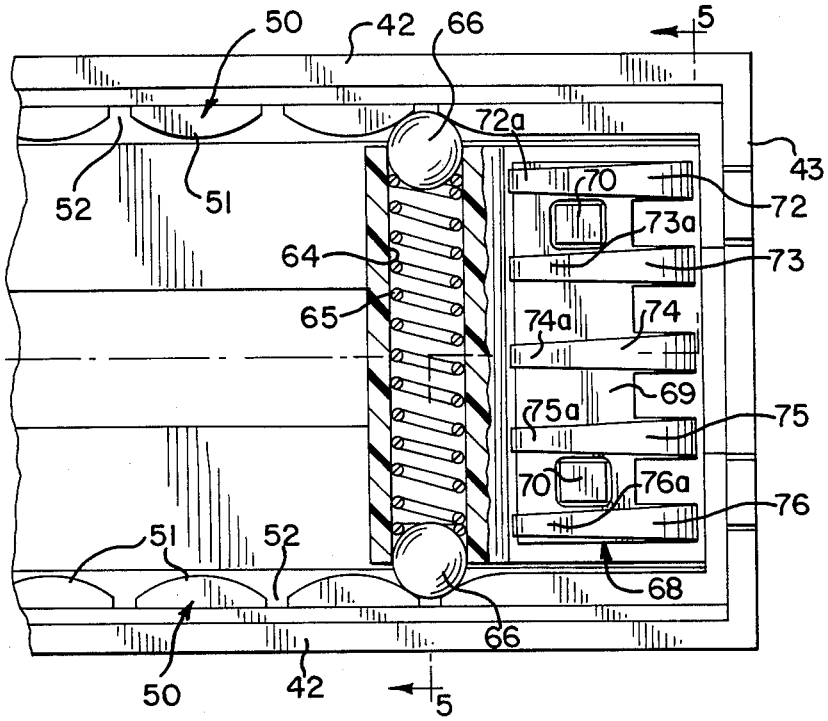
FIG. 4 is an enlarged horizontal fragmentary bottom plan view of the switch with the base removed and also illustrating the actuator in place and in part section to show the detenting arrangement between the ball detents and the indent tracks on the cover.

As seen particularly in FIGS. 3, 4 and 5, at the inner surfaces of the opposed side walls 42, indent tracks 50 are formed as part of the detenting system to coact with detents on the slide actuator 12, as explained more clearly hereafter. The indent tracks 50 include a plurality of equally spaced apart teeth 51 convexly formed and defining therebetween recesses or indents 52. Above the indent tracks 50 a slide actuator guide track 54 is formed to assist in maintaining the slide actuator against lateral movement as it moves longitudinally of the switch. Below the indent tracks 50, as seen in FIGS. 3 and 5, a spacing shoulder 55 is provided against which the ridge 35 of the base body bottoms during assembly. Retention members or tangs 56 having shoulders 56*a* are spaced below the shoulders 55 for coacting with the retaining shoulder 38 on the base to retain it in position within the cover during assembly. The retention tangs 56 are not only provided on the opposite side walls 42 but also on the opposite end walls 43 and in any number sufficient to assist in the assembly of the switch and to properly position the base relative to the cover and lock it in place. The tangs include surfaces sloping to the shoulders 56*a* to facilitate sliding the edges of the base into snap-fit seated position on the cover. While not shown following the assembly of the base with the cover, potting material is normally added over the underside of the base to seal the base with the cover member and more surely prevent the entry of contaminants.

The slide actuator 12 is relatively square in shape looking at it from the top and has extending from the top surface 60 a button or handle 61 which projects through the slot 46 in the cover member so that actuation of the slide actuator along the switch housing can easily be accomplished. It should be appreciated that the slide button or handle may be recessed such that its end is flush with the top surface of the cover if desired. Moreover, the button serves as an indicator the position a slide actuator takes as it is aligned with the ends of the contact arms, as seen in FIG. 3 and as explained more fully hereafter. Where it may be desired to limit travel of the slider 12, the top wall of the cover may be modified by adding holes to accept external stop bars of U-shape.

The upper surface 60 of the slide actuator or slider will slidably bear against the undersurface of the top wall 41 when it is in proper position within the cover and be held there by the spring force of the contact arms. At the left-hand end of the slider when looking at it in FIG. 3, an underlying crossbar portion includes a transversely extending bore 64 within which is received a coil spring 65 bottoming at each end against ball detents 66 which partially protrude from the opposite sides of the slider and engage the indent tracks 50, as particularly seen in FIGS. 4 and 5. Thus, the coil spring 65 resiliently urges the ball detents 66 in opposite directions and into engagement with the indent tracks 50. Movement of the slide actuator longitudinally of the switch will cause the ball detents 66 to move inwardly over the convexly formed teeth 51 and then into each successively arranged indents 52 to provide the primary detenting function for the slide. The gradually sloping sides of the teeth allow a smooth action with the ball detents between detent positions.

Looking again at the side view of the slider 12 in FIG. 3 and noting the right-hand portion of the slider, it will be noted that the slider also carries a contact arm assembly 68 which, as seen in FIG. 4, includes a transversely extending shorting bar 69 suitably apertured to be received on locating pins 70 extending downwardly from the slider and integrally formed with the slider body, and a plurality of leaf-spring contact arms 72, 73, 74, 75 and 76. Each of the contact arms terminates at its free end respectively in U-shaped contacts 72*a*, 73*a*, 74*a*, 75*a* and 76*a* which engage the upper surfce of the base and the contacts when aligned with contact openings in the body of the base. Thus, the contacts are spring loaded and serve to maintain the slide in bearing engagement with the undersurface of the top wall 41 in the guide track 54 when engaging either the upper surface of the base or an exposed contact in the base. The contact arms are arranged in equally spaced relation across the slider and in alignment with the contacts in the base so that they will engage the exposed and transversely aligned contacts as the slider is moved longitudinally of the switch. Thus, the contact arm assembly on the slide actuator provides a combined switching and detenting action. Each position of the slider causes a different registration between the contact arms and the base contacts. Since the assembly carries a set of contact arms of the same number as the number of contact bars, whatever base contacts are exposed at any position of the slider will be engaged by the respectively aligned contact arms to bridge those engaged base contacts. It will be appreciated that when the ball detents are in detent position with the ball engaging indents on the indent tracks, the contacts *72a* to *76a* will be in alignment with one or more transversely spaced openings in the base body to engage the respective base contacts in the openings. The slider body is molded of a suitable electrically insulating plastic as is the cover and the body of the base. The contact arm assembly is preferably made of a suitable electrically conductive copper alloy material producing the desired resilient characteristics to provide proper spring loading of the contact arms against the base.

The spring forces generated by the ball detents spring 65 are substantially greater than those generated by the contact arms 72 to 76. In rest position or a detent position, alos a contact position, the approximate force value for the ball detents spring is 115grams, while the approximate force value for a contact arm is 35 grams. In mid position or between detent positions, the respective values are 270 and 50 grams. The action of the spring biased ball detents also assists in automatically positioning the slider at a contact position.

In operation, as the slider is moved to any one of the ten positions, it will cause the contacts on the contact arm assembly to be aligned with the respective positions of exposed base contacts to make a circuit between those base contacts. In this respect, the contact arm assembly is like a shorting bar so that it can complete the circuit between whatever base contacts are engaged by the slide contacts. The number of contact arms may vary depending on the switch function desired. The width of the slider is such that it is retained in position in the slide actuator guide track 54 against lateral movement to thereby maintain alignment of the contact arms with the base contacts.

In view of the foregoing, it will be appreciated that, in addition to having a primary detenting action performed by the spring biased ball detents engaging the indent tracks on the cover member, additional secondary detenting action is provided by the slider contact arms moving along the base and selectively into contact openings, which is in synchronism with the primary detenting action. As seen particularly in FIG. 3, the openings in the base have rounded edges and the slider contacts likewise have rounded edges to facilitate the engagement therebetween and the movement of the contact arms between positions.

It will be understood that modifications and variations may be effected without departing from the scope of the novel concepts of the present invention, but it is understood that this application is to be limited only by the scope of the appended claims.

The invention is hereby claimed as follows:

1. A linear DIP switch comprising, a base having a generally flat and rectangular body of insulating material with an upper and a lower surface, a plurality of contact bars embedded in said body and exposed on the upper surface thereof at one or more switching positions longitudinal of the body through openings formed in the body at a corresponding position, terminals connected to said contact bars and extending from opposite edges of the body and downwardly therefrom in DIP configuration, a cover having a top wall and opposed side and end walls, said base coacting with said side and end walls, a longitudinal slot in said top wall, and opposed indent track means along said side walls, and a slide actuator disposed within said cover having a button accessible through said slot, detent means on said actuator coacting with said indent track means to define a primary detenting function for said slide actuator and spaced apart detenting positions, and spring contact arms connected together at one end and having free ends engageable with the upper surface of said base and in selective positions with said contact bars through openings in said body on said base for selectively interconnecting selective contact bars at any one position of the actuator, said contact arms generating a force value and the engagement between the free ends of the contact arms and the body openings effecting a secondary detenting function, and each of said detenting positions corresponding to a switching position such that the secondary detenting function is synchronized with said primary detenting function.

2. The switch of claim 1, wherein said indent track means includes spaced apart teeth defining indents therebetween.

3. The switch of claim 2, wherein said teeth are convexly shaped.

4. The switch of claim 2, wherein said detent means includes a pair of opposed ball detents and means resiliently biasing said ball detents into engagement with said indent track means.

5. The switch of claim 4, wherein said means resiliently biasing said ball detents includes a spring bottomed at each end on a ball detent generating a force value substantially greater than the force value generated by said contact arms.

6. The switch of claim 1, wherein the cover further includes means for providing a snap fit relationship between the cover and the base and to locate the base in a predetermined position relative to said cover.

7. The switch of claim 6, wherein said snap fit means includes a shoulder formed on the cover engaging a shoulder on the upper surface of said base and retention members on the cover engaging a shoulder on the lower surface of the base.

8. A linear DIP switch having a plurality of switch positions comprising, a housing having top, bottom, side and end walls and a slide actuator longitudinally movable within said housing, said top wall having a longitudinal slot, said slide actuator having a button accessible through said slot, said bottom wall having a plurality of contacts and terminals extending therefrom in DIP configuration and connected to said contacts, means on the bottom wall between switch positions recessing the contacts from the upper surface of the bottom wall and said side walls having indent tracks on their inner surfaces, said slide actuator including detents resiliently biased into engagement with said indent tracks and a shorting contact assembly having contacts resiliently biased into engagement with the bottom wall and the contacts of said bottom wall.

9. The switch of claim 8, wherein said indent tracks include spaced and convexly shaped teeth and said detents have convexly formed surfaces engaging said tracks.

10. A linear DIP switch comprising, a base having a generally flat and rectangular body of insulating material with an upper and a lower surface, a plurality of contact bars embedded in said body and exposed on the upper surface thereof at one or more switching positions longitudinal of the body through openings formed in the body at a corresponding position, terminals connected to said contact bars and extending from opposite edges of the body and downwardly therefrom in DIP configuration, a cover having a top wall and opposed side and end walls, said base coacting with said side and end walls, a longitudinal slot in said top wall, and opposed indent tracks along said side walls, and a slider disposed within said cover above said base, said slider including a handle accessible through said cover slot, a contact arm assembly of conductive material carried by said slider and having a plurality of leaf spring contact arms engaging said base, the free ends of said arms aligning with said contact bars and selectively engaging the bars exposed through said body openings at selective positions along the base, said arms generating a force value to be resiliently biased against said base, and detent means offset from said contact arms and having a pair of detent balls and a coil spring between the balls resiliently biasing the balls into engagement with said indent track means and generating a substantially greater force value than that generated by said arms to provide positive detenting in synchronism for each of the switching positions.

* * * * *

UNITED STATES PATENT AND TRADEMARK OFFICE

CERTIFICATE OF CORRECTION

PATENT NO. : 4,491,703

DATED : January 1, 1985

INVENTOR(S) : Fred Jaklic

It is certified that error appears in the above-identified patent and that said Letters Patent are hereby corrected as shown below:

Page 1, under "References Cited", insert --United Kingdom Patent 1,477,632--;

Col. 3, line 48, change "and" to --are--;
Col. 4, line 18, after "indicator" insert --to indicate--;
Col. 5, line 22, change "alos" to --also--.

Signed and Sealed this

*Fourth* Day of *June 1985*

[SEAL]

*Attest:*

DONALD J. QUIGG

*Attesting Officer* *Acting Commissioner of Patents and Trademarks*